US008558840B2

(12) United States Patent
Ozaki

(10) Patent No.: US 8,558,840 B2
(45) Date of Patent: Oct. 15, 2013

(54) INTEGRATED CIRCUIT DEVICE AND ELECTRONIC DEVICE

(75) Inventor: Tadafumi Ozaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 301 days.

(21) Appl. No.: 12/945,034

(22) Filed: Nov. 12, 2010

(65) Prior Publication Data

US 2011/0115803 A1 May 19, 2011

(30) Foreign Application Priority Data

Nov. 18, 2009 (JP) ..... 2009-262667

(51) Int. Cl.
*G09G 5/39* (2006.01)

(52) U.S. Cl.
USPC ..... 345/531

(58) Field of Classification Search
USPC ..... 345/530–574
See application file for complete search history.

(56) References Cited

U.S. PATENT DOCUMENTS

| | | | | |
|---|---|---|---|---|
| 5,900,887 | A * | 5/1999 | Leung et al. | 345/531 |
| 5,959,637 | A * | 9/1999 | Mills et al. | 345/506 |
| 2006/0001629 | A1 | 1/2006 | Obinata | |

FOREIGN PATENT DOCUMENTS

| | | |
|---|---|---|
| JP | A-5-334442 | 12/1993 |
| JP | A-6-180566 | 6/1994 |
| JP | A-6-274637 | 9/1994 |
| JP | A-2006-18002 | 1/2006 |

* cited by examiner

*Primary Examiner* — Aaron M Richer
*Assistant Examiner* — Mohammad H Akhavannik
(74) *Attorney, Agent, or Firm* — Oliff & Berridge, PLC

(57) ABSTRACT

An integrated circuit device includes: a memory controller; and a read-modify-write circuit, when the number of bits of each pixel of a first image data is N (N is a natural number), the number of rewrite unit bits of the first image data is M (M is a natural number of M≥N), and the number of bits for which the memory controller can access a image memory at one time is L (L is a natural number of two or more that fulfills L>M), the read-modify-write circuit rewrites pixel data of the first image data corresponding to active write enable signals, among L/M (L and M are each a natural number multiple of N) of write enable signals corresponding to the L bits, into corresponding pixel data of the second image data.

8 Claims, 11 Drawing Sheets

INTEGRATED CIRCUIT DEVICE AND ELECTRONIC DEVICE

The entire disclosure of Japanese Patent Application No. 2009-262667, filed on Nov. 18, 2009 is expressly incorporated by reference herein.

BACKGROUND

1. Technical Field

An aspect of the present invention relates to an integrated circuit device and an electronic apparatus.

2. Related Art

A display controller which carries out a display control is generally used in a display device which displays various images (for example, a display controller disclosed in JP-A-2006-18002). The display controller stores image data input from a host, or the like, in an image memory and, based on the image data, carries out a display control. At this time, there is a case where another image is to be displayed by inserting it in one portion of an image stored in the image memory.

However, when image data of the other image to be inserted are directly written into the image memory, there is a case in which the image data cannot be rewritten in a unit smaller than an access unit as it is only possible to write them in the access unit of the image memory. For example, when the image memory has a 16-bit address, and pixel data use one bit per pixel, the image data can only be rewritten in units of 16 pixels stored in each address. In this case, adjusting the position of an image to be inserted in a unit of one pixel, and writing a diagram such as a circle are difficult.

SUMMARY

According to an advantage of some aspects of the invention, it is possible to provide an integrated circuit device and an electronic apparatus which can insert an image in a unit smaller than an access unit of an image memory.

An embodiment of the invention relates to an integrated circuit device including a memory controller that carries out a process of interfacing with an image memory that stores first image data and a read-modify-write circuit that rewrites the first image data stored in the image memory based on second image data and write enable signals. When the number of bits of each pixel of the first image data is N (N is a natural number), the number of rewrite unit bits of the first image data is M (M is a natural number of M≥N), and the number of bits for which the memory controller can access the image memory at one time is L (L is a natural number of two or more that fulfills L>M), the read-modify-write circuit rewrites pixel data of the first image data corresponding to active write enable signals, among L/M (L and M are each a natural number multiple of N) of the write enable signals corresponding to the L bits, into corresponding pixel data of the second image data.

According to the embodiment of the invention described above, the number of bits of each pixel of the first image data is N, the number of rewrite unit bits of the first image data is M, and the number of bits for which the memory controller can access the image memory at one time is L. In this case, pixel data of the first image data corresponding to active write enable signals, among the L/M write enable signals corresponding to the L bits, are rewritten into corresponding pixel data of the second image data. Because of this, it is possible to insert an image in a unit (M bits; L>M) smaller than an access unit (L bits) of the image memory.

Also, according to an aspect of the invention, when L/M of the write enable signals corresponding to the L bits are inactive, the read-modify-write circuit may not rewrite corresponding pixel data of the first image data.

By so doing, it is possible to rewrite pixel data of the first image data corresponding to active write enable signals among the L/M write enable signals, and not to rewrite corresponding pixel data of the first image data when the L/M write enable signals are inactive.

Also, according to another aspect of the invention, the read-modify-write circuit may include a first buffer that buffers the second image data, and the rewritten first image data may be written to the first buffer.

By so doing, it is possible to buffer the second image data by means of the first buffer, and write the rewritten first image data to the first buffer.

Also, according to still another aspect of the invention, the first buffer may have a k×L-bit (k is a natural number) address, and transfer n×k×L-bit (n is a natural number of two or more) data in a burst mode to the image memory.

By so doing, it is possible to transfer the n×k×L-bit data in the burst mode from the first buffer to the image memory.

Also, according to yet another aspect of the invention, the read-modify-write circuit may, when reading the first image data from the image memory, transmit request signals for n×k×L bits to the memory controller.

By so doing, it is possible, by transmitting the request signals for n×k×L bits to the memory controller, to read the first image data from the image memory.

Also, according to a further aspect of the invention, the read-modify-write circuit may transmit n×k request signals as the request signals for n×k×L bits, and when the write enable signals corresponding to the L bits are inactive, may make corresponding request signals, among the n×k request signals, inactive.

By so doing, it is possible to transmit request signals in accordance with write enable signals. That is, it is possible, when write enable signals corresponding to L bits of the first image data are inactive, to make corresponding request signals, among the n×k request signals, inactive.

Also, according to a still further aspect of the invention, the first buffer may be configured of a first FIFO, the first FIFO may have a variable row number being m (m is a natural number), and the transfer in the burst mode may be controlled such that n×m is constant.

By so doing, it is possible to form the first buffer from the first FIFO. Further, it is possible to control the transfer in the burst mode such that n×m is constant, through varying the row number m of the first FIFO.

Also, according to another aspect of the invention, the integrated circuit device may include a second buffer in which stream image data are input as the first image data or the second image data, wherein the second buffer may convert the format of each set of pixel data of the stream image data into a format of pixel data to be stored in the image memory, and store the pixel data.

By so doing, it is possible to convert the format of each set of pixel data of the stream image data input as the first image data or the second image data into the format of pixel data to be stored in the image memory, and store the pixel data.

Also, according to still another aspect of the invention, the second buffer may be configured of a second FIFO to which input data including a plurality of sets of pixel data are written as the stream image data, and that sequentially shifts the input data in series. When pixel data at the end of a horizontal scanning line are included in the input data, the second FIFO may, by shifting the input data until pixel data at the start of the next horizontal scanning line come to the end of the second FIFO, divide the stream image data at each of the individual horizontal scanning lines.

By so doing, it is possible to form the second buffer from the second FIFO. Further, when pixel data at the end of a horizontal scanning line are included in the input data of the second FIFO, it is possible, by shifting the input data until pixel data at the start of the next horizontal scanning line come to the end of the second FIFO, to divide the stream image data at each of the horizontal scanning lines.

Also, another embodiment of the invention relates to an electronic apparatus including the heretofore described integrated circuit device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, a detailed description will be given of a preferred embodiment of the invention. The embodiment to be described hereafter does not unduly limit details of aspects of the invention described in the claims, and not all configurations described in the embodiment are necessarily essential as solutions of the aspects of the invention.

1. Comparison Example

Figure 1A:
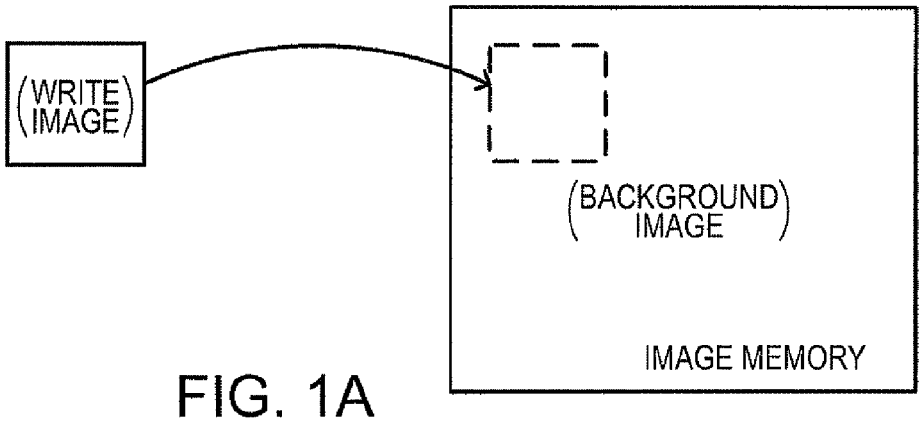
FIGS. 1A to 1D are illustrations of a comparison example.

First, a description will be given, using FIGS. 1A to 1D, of an example for comparison with the embodiment. FIG. 1A schematically shows an SRAM (an image memory) included in a display controller which controls an image display of a display device. As shown in FIG. 1A, it is taken that image data of a background image previously input into the display controller are stored in the SRAM. For example, when displaying a pop-up operation menu of the display device, or the like, there is a case where an image is to be written over one portion of the background image. In this case, in the comparison example, one portion of the image data of the background image stored in the SRAM is directly overwritten with image data of a write image input in the display controller.

Figure 1B:
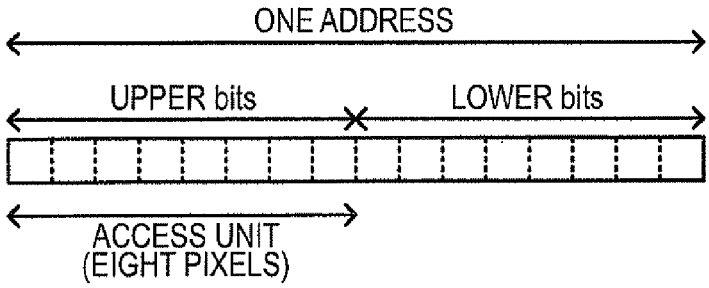

As shown in FIG. 1B, it is taken that 16-bit data are stored in each address of the SRAM. For example, the SRAM uses mask signals (an LDMQ signal and a UDMQ signal) to set as to whether or not to permit access to the upper eight bits of each address, and whether or not to permit access to the lower eight bits of each address. At this time, a minimum access unit rewritable in one access to the SRAM is eight bits (L bits in the broad sense, where L is a natural number of two or more). Then, when each pixel of the image data is composed of, for example, one bit (N bits in the broad sense, where N is a natural number fulfilling N<L) of data, the result is that the image data of the SRAM can only be rewritten in units of eight pixels.

Figure 1C:
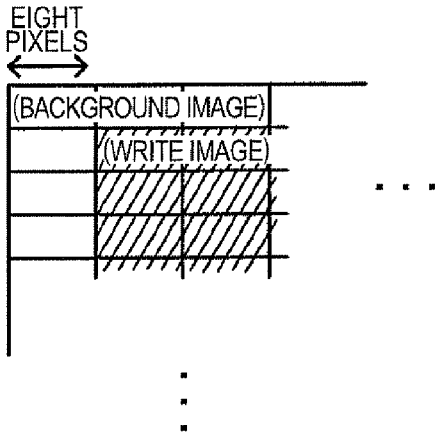
Figure 1D:
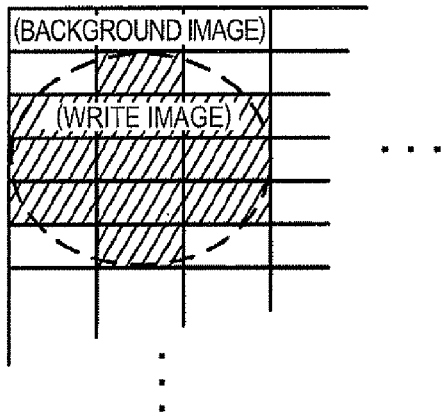

For this reason, the result is that a position of the background image in which the write image is to be inserted can only be adjusted in units of eight pixels, as shown in FIG. 1C. Also, in the event of attempting to insert a diagram such as a circle into the background image, the circle cannot be smoothly inserted in the background image, as shown in FIG. 1D. In this way, there is a problem in that, when a write image is directly written to the SRAM, it cannot be overwritten in a unit smaller than the access unit (L bits) of the SRAM.

2. Configuration Example

Figure 2:
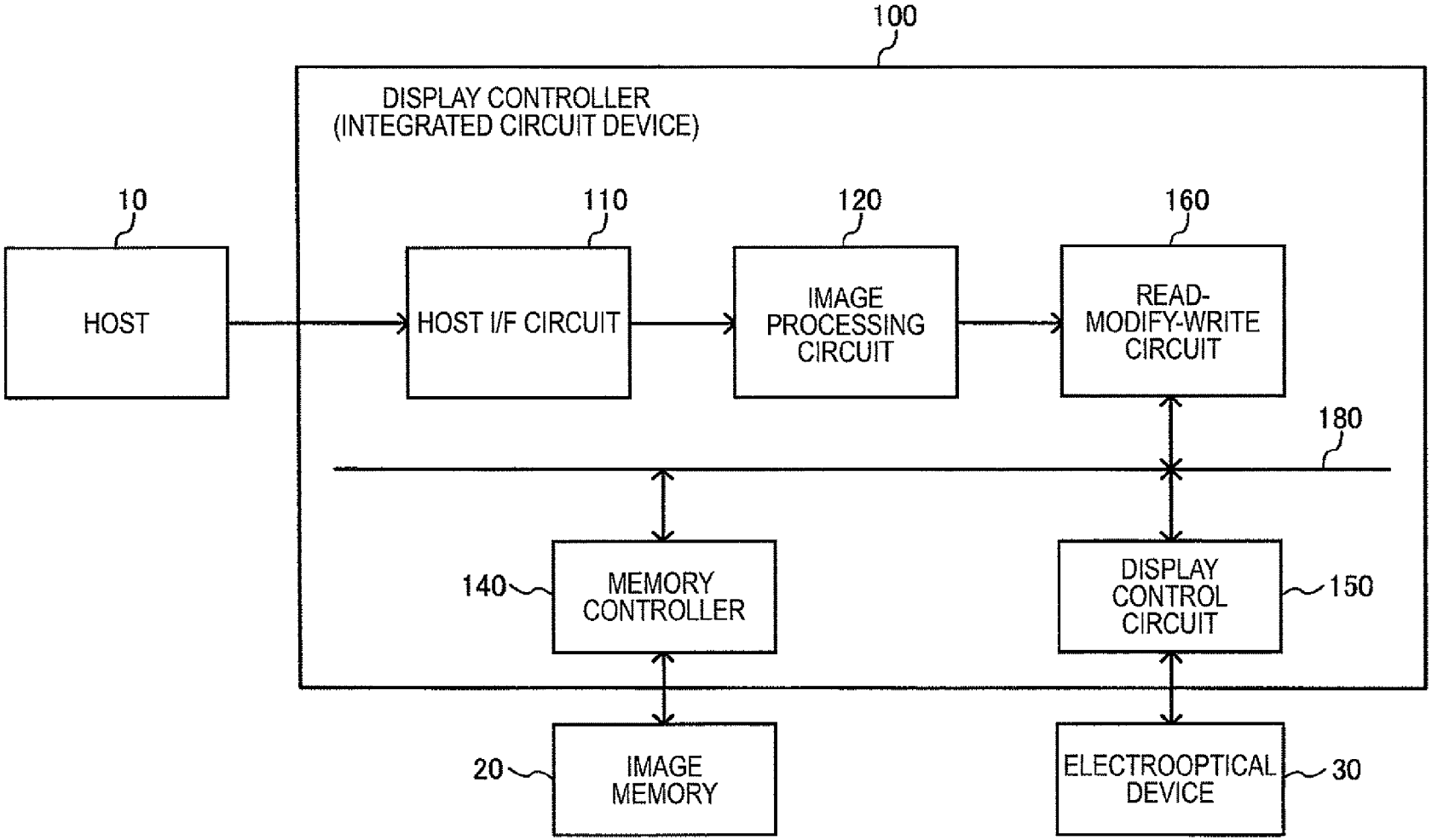
FIG. 2 is a configuration example of a display controller of an embodiment.

FIG. 2 shows a configuration example of a display controller of the embodiment with which rewriting is possible in a unit (M bits; M is a natural number fulfilling L>M≥N) smaller than an access unit (L bits) of an SRAM (an image memory in the broad sense). The display controller 100 (an integrated circuit device in the broad sense) includes a host I/F circuit 110 (a host interface circuit), an image processing circuit 120, a memory controller 140 (a memory interface circuit), a display control circuit 150, a read-modify-write circuit 160, and an internal bus 180. It is noted that the embodiment is not limited to this configuration, and it is possible to make various modifications, such as, omission of one portion (for example, the image processing circuit) of these components, or addition of another component.

The display controller 100 stores background image data (first image data) input from a host 10 in an image memory 20. Then, the display controller 100 inserts a write image in a background image, by rewriting the background image data stored in the image memory 20, based on write image data (second image data) input from the host 10.

Specifically, the host I/F circuit 110 carries out various interface processes with the host 10 (a host device or an external device), and receives the background image data and write image data from the host 10. For example, the host I/F circuit 110 receives the background image data and write image data as stream image data. The host 10 and host I/F circuit 110 are connected by, for example, a serial bus or a parallel bus. Further, the host I/F circuit 110 communicates interface signals, such as, a data signal, an address signal, or a write/read signal, with the host 10, thus realizing an interface with the host 10.

The image processing circuit 120 carries out an image processing of an image (image data) received by the host I/F circuit 110. For example, the image processing circuit 120 carries out a processing, such as rotation, smoothing, trimming, luminance enhancement, or color enhancement of the image. The image processing circuit 120 may include an unshown line buffer. The line buffer may be configured of, for example, an SRAM, and buffers (temporarily stores) image data to be transferred to the image memory 20.

The read-modify-write circuit 160 transfers the background image data from the image processing circuit 120 to the image memory 20. Then, the read-modify-write circuit 160 reads the background image data from the image memory 20, rewrites the read data based on the write image data from the image processing circuit 120, and writes the rewritten data to the image memory 20. Specifically, the read-modify-write circuit 160 rewrites the background image data based on write enable signals. The write enable signals may be, for example, signals supplied from the host 10 or signals generated by the image processing circuit 120, and are composed of bits corresponding to pixels of the write image data. Whether or not to rewrite each pixel of the background image data is set by the write enable signals. In the embodiment, the read-modify-write circuit 160 controls the rewriting, using the write enable signals, thereby enabling the background image data to be rewritten in a unit smaller than the access unit of the image memory 20.

The memory controller 140 carries out an interface process with the internal bus 180 and a read/write control over the image memory 20. Specifically, the memory controller 140 receives the image data from the read-modify-write circuit 160, and writes (stores) the image data to (in) the image memory 20. Also, the memory controller 140 reads the image data stored in the image memory 20, and transfers (transmits) the read data to the display control circuit 150. The memory controller 140 may, for example, carry out the read/write control in a burst mode by specifying a start address, or carry out the read/write control individually for each address.

The image memory 20 (a video memory or a VRAM) may be configured of, for example, an SRAM, is provided for storing image data of an image to be displayed on an electrooptical device 30. The image memory 20 may be configured as an external memory of the display controller 100. That is, the image memory 20 may be configured as an integrated circuit device independent of the display controller 100. Alternatively, the image memory 20 may be included in the display controller 100. For example, the image memory 20 may be built in a chip (die) of the display controller 100, or a chip of the image memory 20 may be stacked on the chip of the display controller 100.

The display control circuit 150 carries out a display control of the electrooptical device 30 based on the image data from the memory controller 140. For example, the display control circuit 150 outputs a display data signal or a control signal (a synchronization signal or the like) to the electrooptical device 30. The electrooptical device 30 may include an electrooptical panel, such as, for example, a liquid crystal panel or an electrophoretic display, a data driver (a source driver) that drives data lines (source lines) of the electrooptical panel, a scanning driver (a gate driver) that drives scanning lines (gate lines) of the electrooptical panel, and the like.

Heretofore, a description has been given, as an example, of a case in which the background image data from the host 10 are written to the image memory 20 via the image processing circuit 120 and read-modify-write circuit 160. However, in the embodiment, the image processing circuit 120 may be connected to the internal bus 180, or the background image data from the host 10 may be written to the image memory 20 without going through the read-modify-write circuit 160.

3. Operation Example

A description will be given, using FIGS. 3A, 3B, and 4, of an operation example of the embodiment in which background image data are rewritten using write enable signals. Hereafter, a case in which M=N will be described as an example. That is, a case in which a one-bit write enable signal corresponds to one pixel will be described as an example. However, in the embodiment, it is also acceptable that M>N (M is a natural number multiple of N). In other words, a one-bit write enable signal may correspond to a plurality of pixels.

Figure 3A:
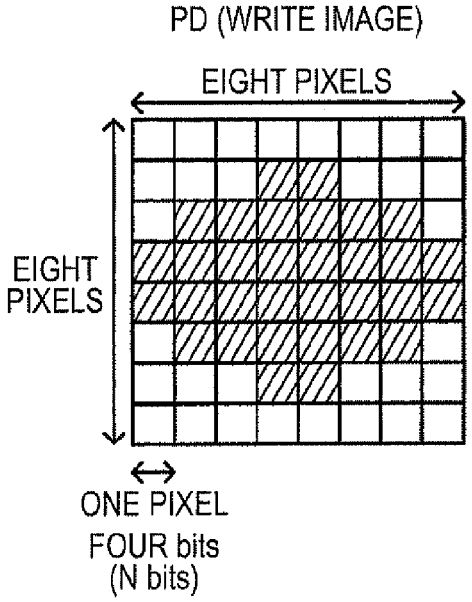
FIGS. 3A and 3B are operational illustrations of the embodiment.

As shown in FIG. 3A, it is taken that eight by eight pixels of image data are supplied as write image data, and that image data of each pixel are configured of four bits (N bits in the broad sense) of data.

Figure 3B:
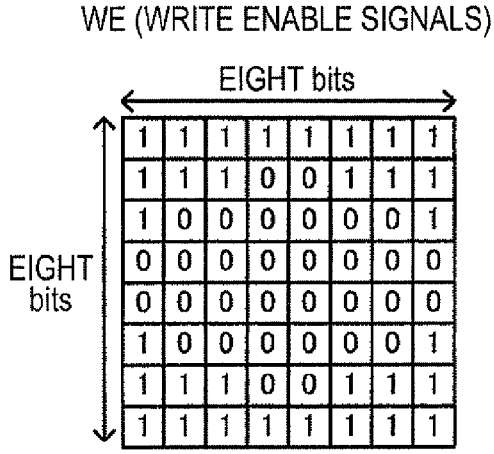

In this instance, write enable signals configured of eight by eight-bit signals (data) are input, as shown in FIG. 3B. Each of the bits of the write enable signals corresponds to each of the pixels of the write image data (M=N=4). Then, a bit value "0" (a first logic level in the broad sense) refers to an active bit indicating a rewrite of the pixel data, and a bit value "1" (a second logic level in the broad sense) refers to an inactive bit indicating a non-rewrite (a mask) of the pixel data.

Figure 4:
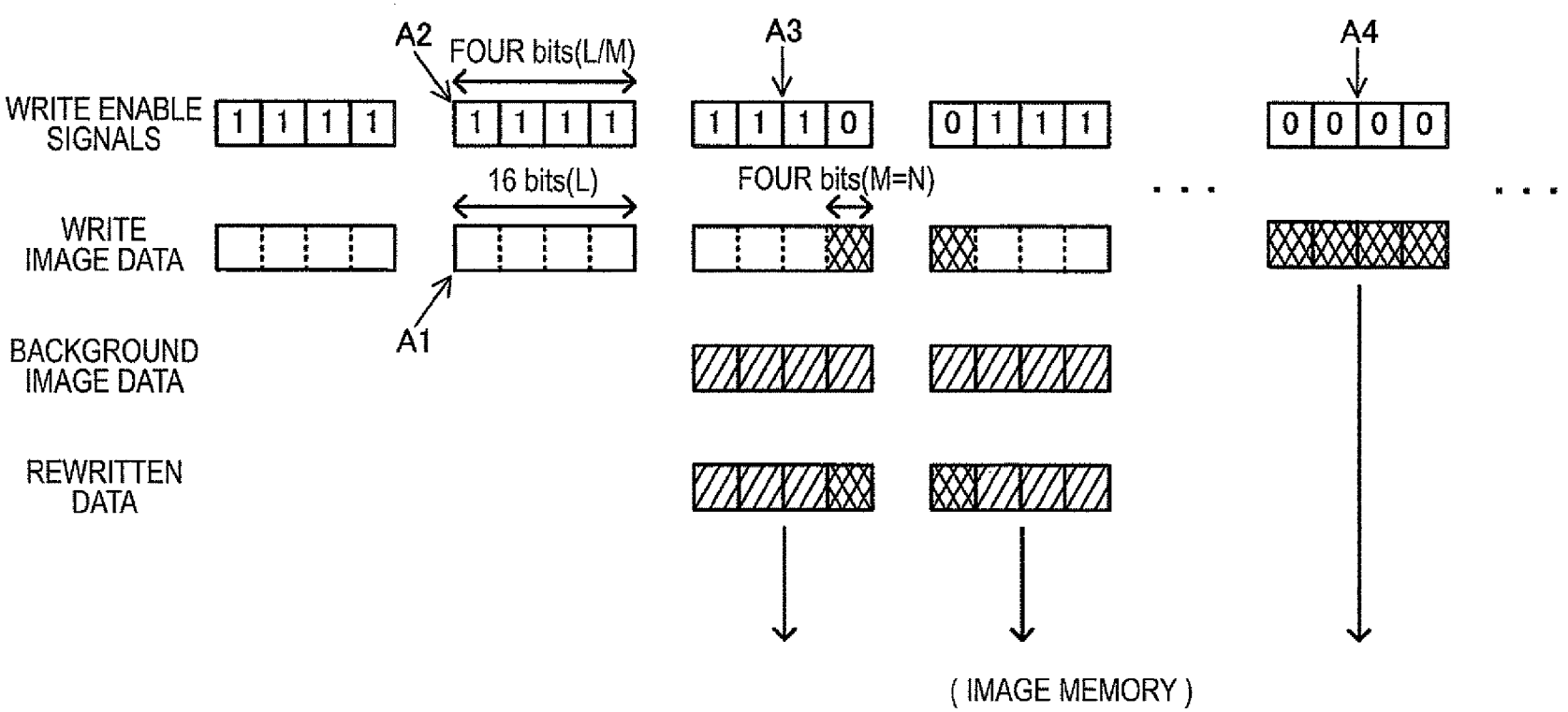
FIG. 4 is an operational illustration of the embodiment.

As shown in A1 of FIG. 4, it is determined as to whether or not to rewrite the background image data, for example, every 16 bits of the write image data. The 16 bits (L bits in the broad sense), define an access unit of the image memory 20, and may correspond to the number of bits in, for example, one address of the image memory 20. Alternatively, they may be the number of bits access-controlled by the mask signal in each address of the image memory 20.

As shown in A2, when all write enable signals of four bits (L/M bits) corresponding to 16 bits of write image data are "1", no rewriting of the background image data is carried out. As shown in A3, when "0" and "1" are mixed in the write enable signals of four bits, the background image data are read from the image memory 20. Then, pixel data of the background image data corresponding to "0" of the write enable signals are rewritten with pixel data of the write image data. As pixel data of the background image data corresponding to "1" of the write enable signals, the pixel data of the background image data are used as they are. Then, the rewritten data are stored in the original address of the image memory 20. As shown in A4, when all the write enable signals of four bits are "0", the write image data are written to a corresponding address of the image memory 20 without reading the background image data.

In FIG. 4, a description has been given, as an example, of a case in which each write enable signal is configured of one bit of data. However, in the embodiment, each write enable signal may be configured of plural-bit data.

It is noted that, as described above in the comparison example, there is a problem in that the background image data stored in the image memory, when directly overwritten with the write image data, cannot be overwritten in a unit smaller than the access unit (L bits) of the image memory.

In this respect, according to the embodiment, when the number of bits in each pixel of the background image data is N, the number of rewrite unit bits of the background image data is M (L>M≥N), and the number of bits for which the memory controller 140 can access the image memory 20 at one time is L, pixel data of the background image data corresponding to active write enable signals, among L/M write enable signals corresponding to the L bits, are rewritten to corresponding pixel data of the write image data.

For example, when rewriting is carried out through accessing the image memory 20 every 16 bits (L bits) of each address thereof, as described above in FIG. 4, L=16-bit background image data are rewritten every M=N=4-bit pixel data based on write enable signals of L/M=4 bits.

By so doing, as the background image data stored in the image memory 20 are rewritten based on the write enable signals, the background image data can be rewritten in a unit (M bits) smaller than the access unit of the image memory 20.

More specifically, in the embodiment, when the L/M write enable signals are a mix of active ("0") and inactive ("1") signals, by rewriting pixel data among the read background image data corresponding to the active signals, rewriting of the pixel data is carried out. Also, when the entire L/M write enable signals are active ("0"), by directly writing the write image data to the image memory 20, rewriting of the pixel data is carried out.

By so doing, it is possible to rewrite the background image data every pixel based on the write image data and write enable signals. Specifically, it is possible, based on L/M-bit write enable signals each corresponding to each pixel of the background image data, to rewrite L bits of the background image data in a unit smaller than the access unit of the image memory 20.

Also, in the embodiment, when the L/M write enable signals are inactive ("1"), corresponding pixel data in the background image data are not rewritten. Specifically, as described in FIG. 4 and the like, no reading of the background image data from the image memory 20 or writing to the image memory 20 is carried out.

By so doing, when it is unnecessary to rewrite L bits for which the image memory 20 can be accessed at one time, it is possible not to rewrite the L bits of background image data. Also, by avoiding an access to the image memory 20 when no rewriting is necessary, it is possible to eliminate an excess access.

4. Read-Modify-Write Circuit

Figure 5:
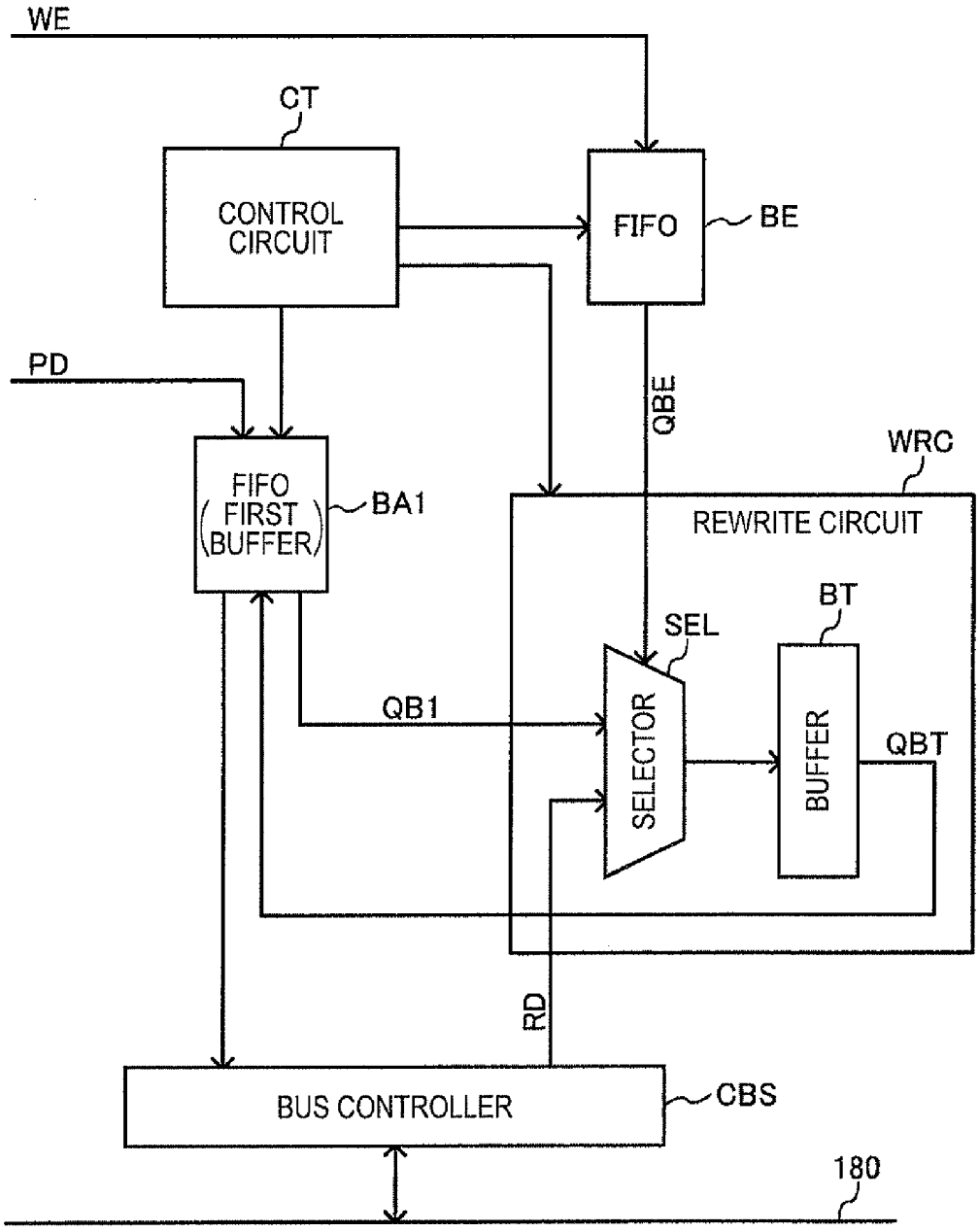
FIG. 5 is a detailed configuration example of a read-modify-write circuit.

FIG. 5 shows a detailed configuration example of the read-modify-write circuit 160 that can realize the heretofore described operation example. The read-modify-write circuit 160 includes a control circuit CT, a FIFO circuit BA1 (a first buffer in the broad sense), a FIFO circuit BE (a buffer in the broad sense), a rewrite circuit WRC, and a bus controller CBS. The read-modify-write circuit 160 of the embodiment is not limited to this configuration, and it is possible to make various modifications, such as, omission of one portion (the FIFO circuit BE or a buffer BT) of the components, addition of another component and the like.

The FIFO circuit BA1 receives write image data PD, and outputs write image data QB1 that are a rewrite object to the rewrite circuit WRC. Also, when background image data are input from the host, the FIFO circuit BA1 outputs the data to the bus controller CBS, instead of outputting the data to the rewrite circuit WRC. Here, the write image data QB1 that are the rewrite object are, for example, data for one address of the FIFO circuit BA1. Alternatively, they may be data, among data stored in the FIFO circuit BA1, which have been input earliest, or data which have reached the lowermost row (or the uppermost row) of the FIFO circuit BA1.

The FIFO circuit BE receives write enable signals WE, and outputs write enable signals QBE corresponding to the data QB1 which are the rewrite object to the rewrite circuit WRC. For example, the write enable signals QBE are data, among data stored in the FIFO circuit BE, which have been input earliest, or data which have reached the lowermost row (or the uppermost row) of the FIFO circuit BE.

The rewrite circuit WRC rewrites background image data RD, which are a rewrite object and have been read from the image memory 20, based on the write image data QB1 and write enable signals QBE. Then, the rewrite circuit WRC writes rewritten image data QBT to (over) addresses that store the write image data QB1 of the FIFO circuit BA1. The rewritten image data written to the FIFO circuit BA1 are transferred from the FIFO circuit BA1 to the image memory 20 via the bus controller CBS.

More specifically, the rewrite circuit WRC includes a selector SEL and a buffer BT. The selector SEL, based on the write enable signals QBE from the FIFO circuit BE, selects either the write image data QB1 from the FIFO circuit BA1 or the background image data RD from the image memory 20. The buffer BT stores the data selected by the selector SEL. For example, the buffer BT is configured of a register or a memory that stores data for one address of the FIFO circuit BA1.

The control circuit CT may be configured of, for example, a sequencer, and controls each component of the read-modify-write circuit 160. For example, the control circuit CT, based on the write enable signals WE, determines as to whether or not rewriting of the background image data is necessary, and in the event that rewriting is necessary, instructs the rewrite circuit WRC to rewrite. Also, the control circuit CT controls data input timing or data output timing of the FIFO circuits BA1 and BE, or controls rewrite timing of the rewrite circuit WRC.

The bus controller CBS controls data transfer (data communication) between components connected to the internal bus 180. For example, the bus controller CBS carries out image data transfer by transmitting a read command or a write command, a request signal, a data signal, an address signal, or the like, to the memory controller 140. The bus controller CBS may carry out burst mode data transfer between the FIFO circuit BA1 and the image memory 20, or may carry out data transfer for each address.

5. Read-Modify-Write Process

Figure 6:
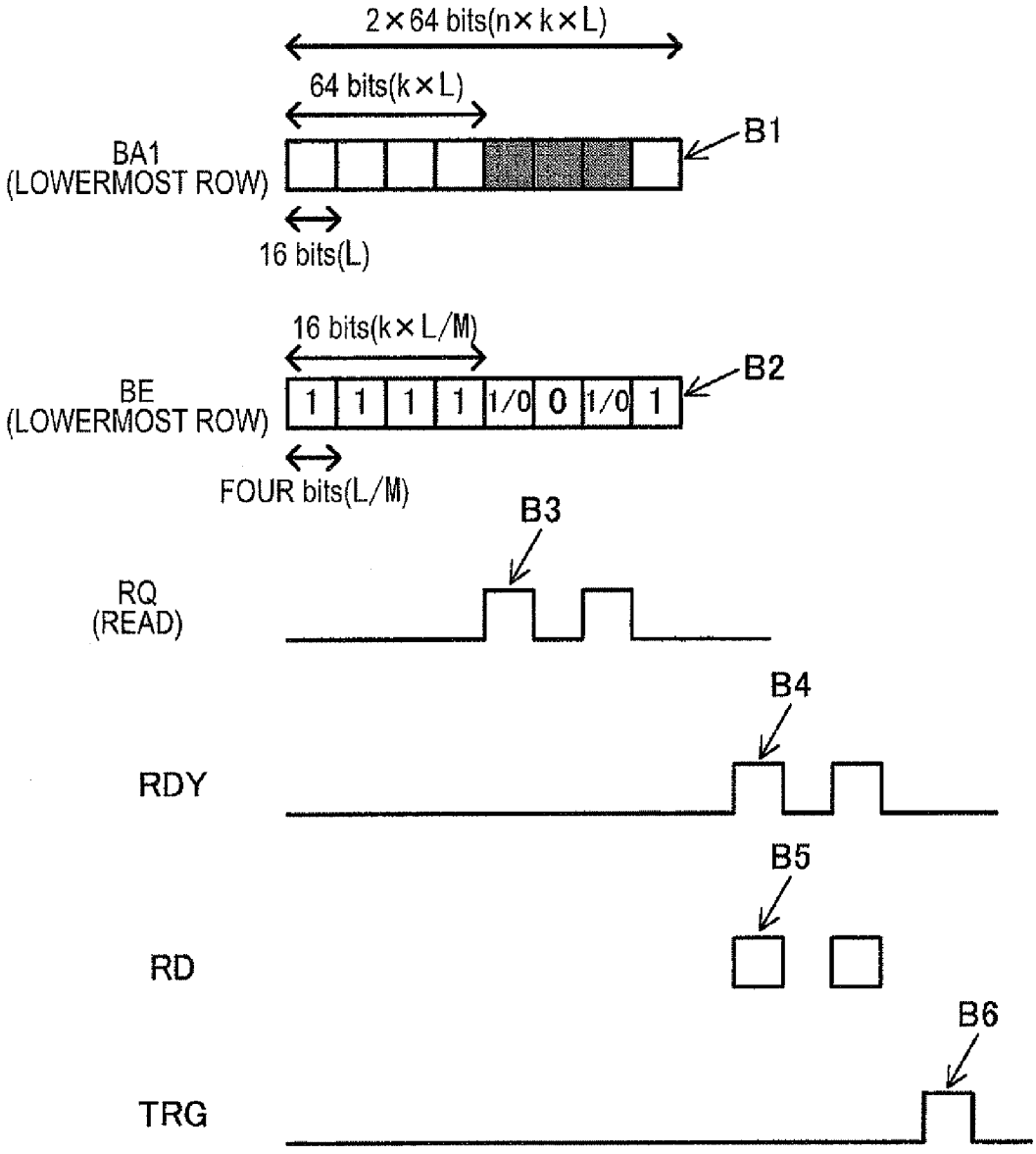
FIG. 6 is an operation example of a read-modify-write process.

A description will be given, using FIGS. 6 to 8, of an operation example of a read-modify-write process in the heretofore described detailed configuration example. FIG. 6 schematically shows an example of operation of reading background image data. Hereafter, it is taken that 64 bits (k×L bits in the broad sense; k is a natural number) of data are stored in each address of the FIFO circuit BA1, and 2×64 bits (n×k×L bits in the broad sense; n is a natural number) of data are stored in each row. Then, it is taken that the 2×64 bits of data in the lowermost row, after being rewritten, are burst transferred to the image memory 20.

B1 of FIG. 6 shows write image data in the lowermost row of the FIFO circuit BA1. In FIG. 6, it is taken that one block represents 16 bits of data, and one address of the image memory 20 has 16 bits (in the broad sense, L bits). Also, it is taken that one pixel of the image data is made of four bits (N bits in the broad sense). B2 shows write enable signals in the lowermost row of the FIFO circuit BE. In FIG. 6, one block represents a four-bit write enable signal. Then, "1" in the block indicates that the four bits are all "1", "0" indicates that the four bits are all "0", and "1/0" indicates that "1" and "0" are mixed. The number of write enable signals corresponding to one address of the FIFO circuit BA1 is 16 (k×L/M in the broad sense).

As shown in B3, in a background image data read operation, a request signal RQ for requesting to read data from the image memory is output. The request signal RQ is a signal corresponding to a write enable signal in the lowermost row of the FIFO circuit BE. Specifically, when a four-bit write enable signal corresponding to one address of the image memory is made of a mix of "1" and "0", a request signal corresponding to the address is made active. Then, a ready signal RDY is transmitted from the memory controller, as shown in B4, and background image data RD in a requested address are read, as shown in B5. A rewrite trigger signal is made active after the reading finishes, as shown in B6.

Figure 7:
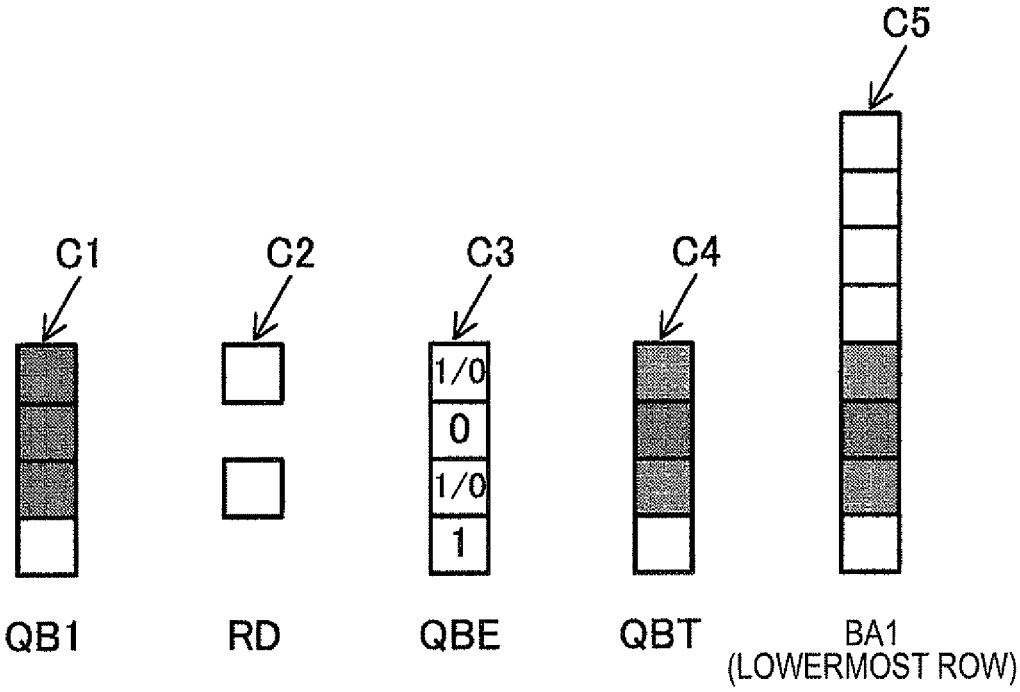
FIG. 7 is an operation example of the read-modify-write process.

FIG. 7 schematically shows an example of operation of rewriting the read background image data. As shown in C1 of FIG. 7, data QB1 for one address, among the data in the lowermost row of the FIFO circuit BA1, are input in the selector SEL. As shown in C2 and C3, background image data RD and write enable signals QBE corresponding to the data QB1 are input in the selector SEL. Then, as shown in C4, data selected by the selector SEL are buffered by the buffer BT. As shown in C5, the data of the buffer ET are stored in a corresponding address in the lowermost row of the FIFO circuit BA1.

Figure 8:
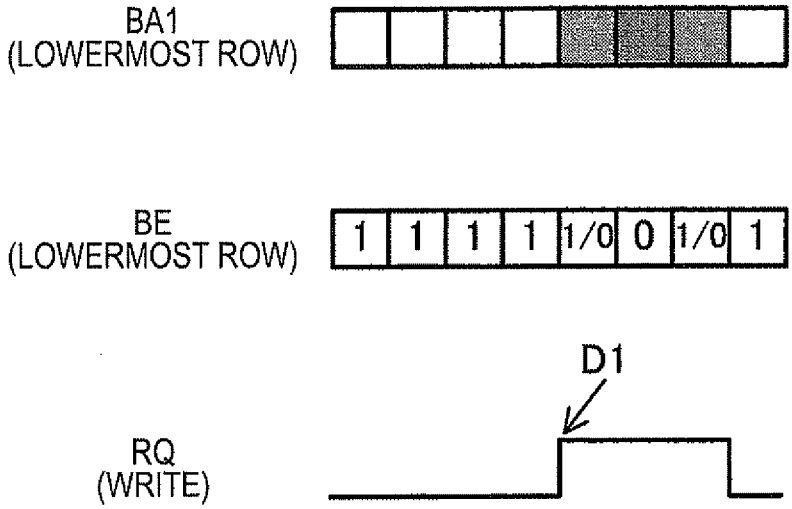
FIG. 8 is an operation example of the read-modify-write process.

FIG. 8 schematically shows an example of operation of writing the rewritten data to the image memory. As shown in D1 of FIG. 8, a request signal RQ that requests writing to the image memory is output. The request signal RQ is a signal corresponding to write enable signals for the lowermost row of the FIFO circuit BE. Specifically, when a four-bit write enable signal corresponding to one address of the image memory includes a mix of "1" and "0", and when it includes only "0", a request signal corresponding to the address is made active. Then, the image data from the FIFO circuit BA1 are written to the address of the image memory at which the corresponding request signal RQ has been made active.

As described above, according to the embodiment, the FIFO circuit BA1 that buffers write image data is included. Then, rewritten background image data are written in units of k×L bits in the FIFO circuit BA1. For example, as described in FIG. 6 and the like, the background image data are written in units of 64 bits, which is the number of bits in one address of the FIFO circuit BA1.

By so doing, it is possible to use the FIFO circuit BA1 in both buffering background image data and storing rewritten background image data. Also, by writing rewritten background image data in the FIFO circuit BA1, it is possible to transfer the background image data to the image memory 20.

In the embodiment, when a write enable signal for the lowermost row of the FIFO circuit BE includes only "1", it is not necessary to carry out the rewrite operation described above. In this case, the rewrite image data in the lowermost row of the FIFO circuit BA1 may be transferred to the image memory 20 as they are. By so doing, it is possible to eliminate an unnecessary rewrite operation, and speed up the read-modify-write process.

Also, in the embodiment, the number of bits in one address of the FIFO circuit BA1 is k×L, and the n×k×L-bit data of the FIFO circuit BA1 are transferred in the burst mode to the image memory 20.

By so doing, reading or rewriting at each and every address (L bits) of the image memory is not necessary, such that it is possible to speed up the read-modify-write process. In other words, in the case of rewriting at each address, latency (a delay time from a request until read data are transmitted) at the time of reading from the image memory occurs at each address. Meanwhile, with a burst transfer, latency occurs only once in one burst transfer, such that it is possible to save read time.

Also, in the embodiment, when reading background image data from the image memory 20, request signals for n×k×L bits are transmitted to the memory controller 140. For example, as described in FIG. 6 and the like, request signals RQ corresponding to the 2×64-bit write image data are transmitted.

By so doing, it is possible to read n×k×L bits of background image data corresponding to the n×k×L bits of write image data in the burst mode from the image memory 20.

More specifically, in the embodiment, n×k request signals are transmitted as the request signals for n×k×L bits. Then, when write enable signals corresponding to L bits of the write image data are inactive, corresponding request signals, among the n×k request signals, are made inactive. For example, as described in FIG. 6 and the like, 2×64/16=8 request signals RQ are transmitted, and when all the four bits of each of write enable signals corresponding to L=16 bits of write image data are "1", a corresponding request signal RQ is made inactive.

By so doing, it is possible to read only background image data in an address that needs to be rewritten, from among the background image data in each address of the image memory 20. That is, it is possible to read only background image data with write enable signals corresponding thereto being a mix of "0" and "1", and which need to be rewritten for each pixel, from the image memory 20.

In the embodiment, the FIFO circuit BA1 may be such that, when its variable row number is m (m is a natural number), transfer in the burst mode may be controlled in such a way that n×m is constant. For example, the FIFO circuit BA1 may be configured of a memory such as an SRAM. Then, by carrying out an address control that changes the number of rows m of the FIFO in such a way that it is inversely proportional to the number of addresses n to be transferred in one burst transfer (the burst number), the transfer in the burst mode may be controlled in such a way that n×m is constant.

By so doing, it is possible to make the burst number n in data transfer from the FIFO circuit BA1 to the image memory 20 variable. Also, by controlling the transfer in the burst mode in such a way that n×m is constant, it is possible to make effective use of the resource of the FIFO circuit BA1.

6. Second Configuration Example

Figure 9:
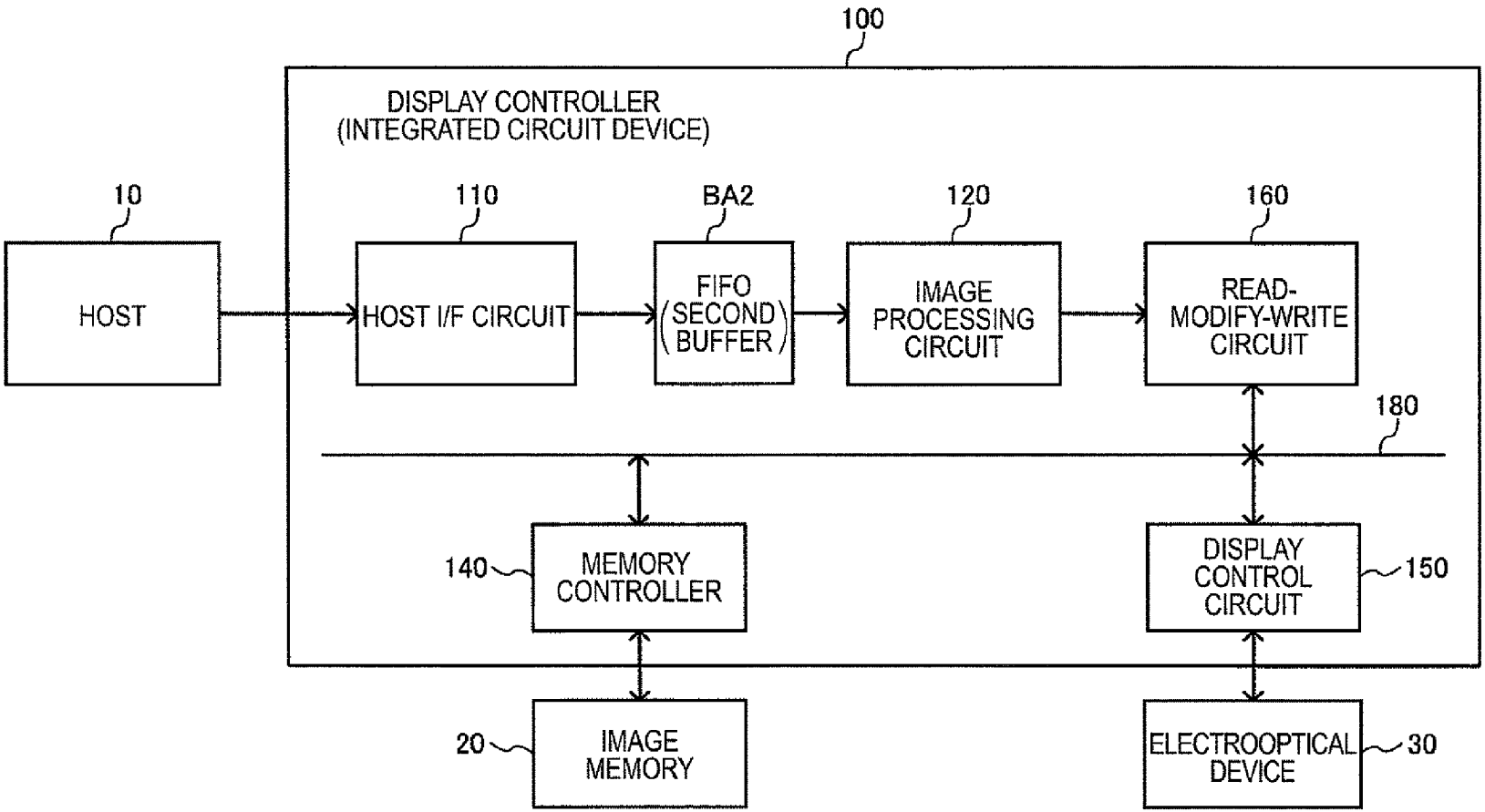
FIG. 9 is a second configuration example of the display controller of the embodiment.

FIG. 9 shows a second configuration example of the display controller of the embodiment. A display controller 100 (an integrated circuit device in the broad sense) shown in FIG. 9 includes a host I/F circuit 110, an FIFO circuit BA2 (a second buffer circuit in the broad sense), an image processing circuit 120, a memory controller 140, a display control circuit 150, a read-modify-write circuit 160, and an internal bus 180. Hereafter, components such as the host I/F circuit described in FIG. 2 and the like will be given identical reference numerals, and their description will be omitted if appropriate. Herein, the embodiment is not limited to this configuration, and it is possible to make various modifications, such as, omission of one portion (for example, the image processing circuit) of the components, addition of another component, and the like.

The FIFO circuit BA2 buffers (temporarily stores) image data from a host 10 (external), and outputs the buffered image data to the image processing circuit 120. Also, the FIFO circuit BA2 carries out an unpacking process on image data supplied from the host 10 (external) as stream image data. For example, as will be described in FIG. 10 and the like, a process of converting the format of pixel data of the stream image data, or a process of dividing the pixel data at each of the horizontal scanning lines, is carried out as the unpacking process. The unpacked data are transferred to an unshown line buffer included in the image processing circuit 120. The FIFO circuit BA2 is configured of, for example, a shift register having a plurality of flip-flop circuits connected in sequence.

Figure 10:
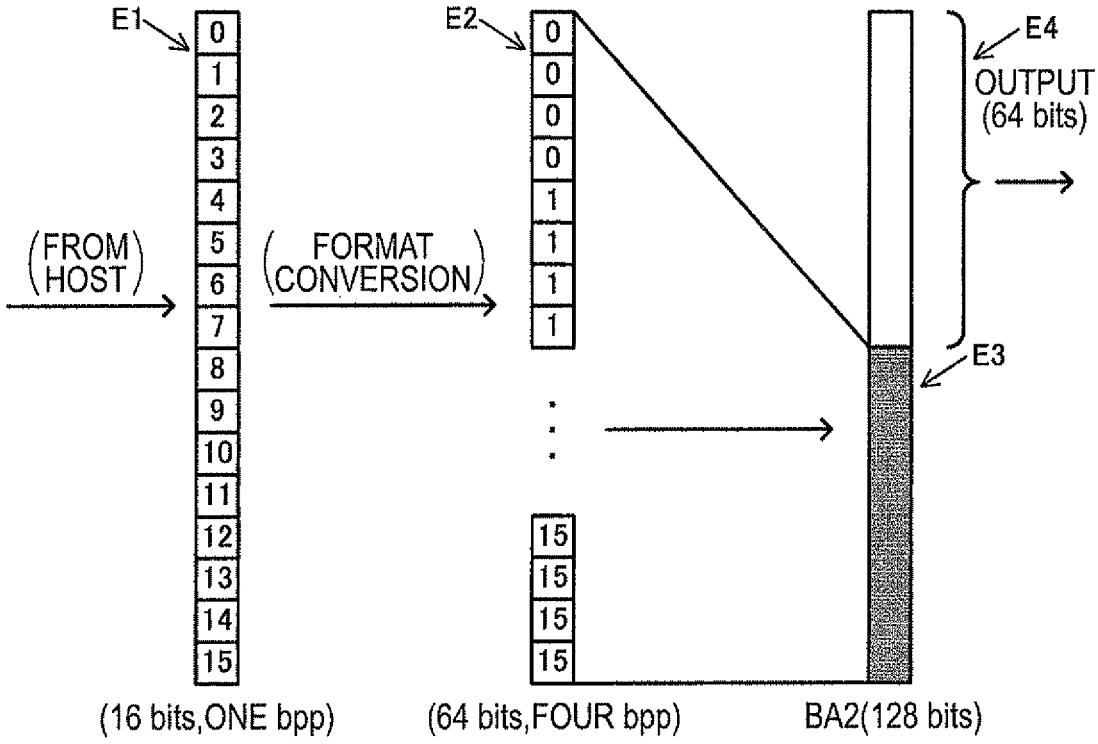
FIG. 10 is an operational illustration of a second buffer.

A description will be given, using FIGS. 10 and 11, of an operation example of the FIFO circuit BA2. FIG. 10 shows an operation example of the pixel data format conversion. As shown in E1 of FIG. 10, stream image data are supplied from the host 10 by, for example, a 16-bit parallel bus. It is taken that each set of pixel data of the stream image data is of one bit (one bit per pixel (bpp)).

Herein, the format of image data in the display controller 100 is taken to be such that each set of pixel data is of four bits (four bpp). By so doing, as shown in E2, the format of the stream image data is converted from one bpp into four bpp. For example, pixel data "1" of the stream image data from the host are converted into "1111", and "0" into "0000". Then, as shown in E3, 64 bits of image data after the format conversion are stored in the FIFO circuit BA2. As shown in E4, the 64 bits of image data previously stored in the FIFO circuit BA2 are transferred to the image processing circuit 120.

In this way, in the embodiment, the display controller includes the FIFO circuit BA2 in which the stream image data are input as background image data or write image data. Then, the FIFO circuit BA2 format-converts and stores each set of pixel data of the stream image data.

By so doing, the format of the stream image data can be converted into a format to be used in the display controller. For example, when the bpp of image data stored in the image memory 20 differs from the bpp of the stream image data, it is possible to carry out a format conversion of the former bpp.

Figure 11:
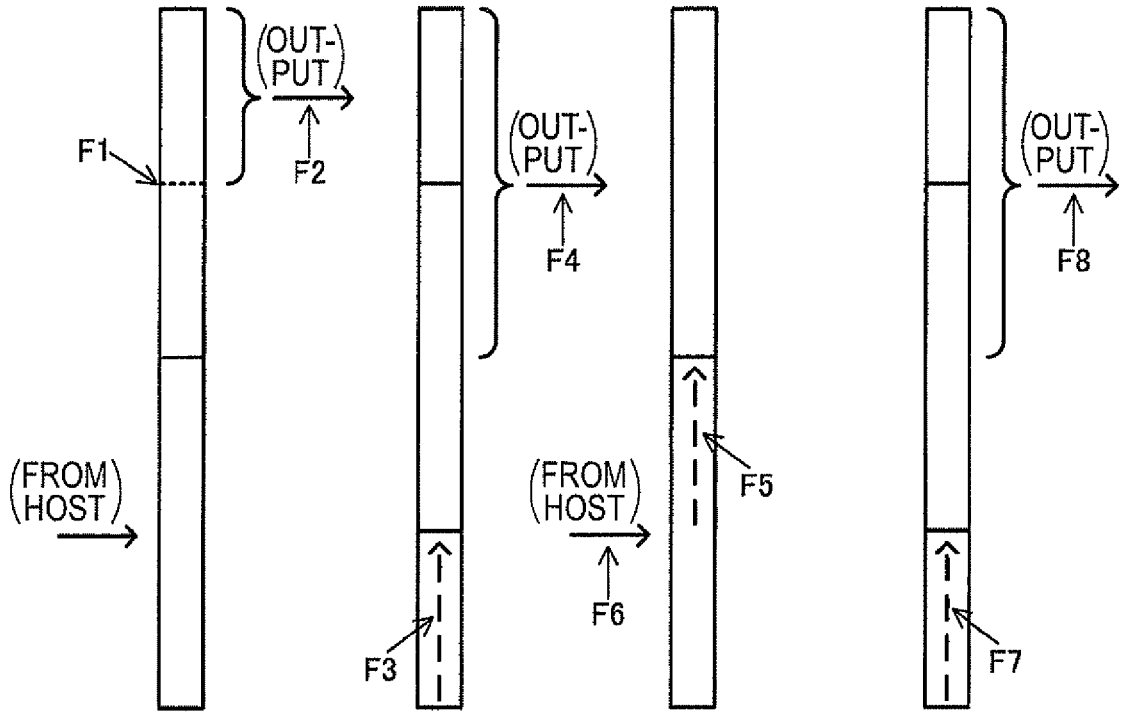
FIG. 11 is an operational illustration of the second buffer.

FIG. 11 shows an operation example of the process of dividing the stream image data at each horizontal scanning line. As shown in F1 of FIG. 11, for example, it is taken that the end of a horizontal scanning line is present at the eighth pixel of 16 pixels (64 bits). At this time, as shown in F2, pixel data of eight pixels including the end are transferred to the image processing circuit 120. Pixel data of the remaining eight pixels are filled with, for example, "0". Then, as shown in F3, the data are shifted by eight pixels, and as shown in F4, pixel data of the first 16 pixels in the next horizontal scanning line are transferred.

As shown in F5, the data are shifted by eight pixels, and as shown in F6, image data of 16 pixels are written from the host 10. Then, as shown in F7, the data are shifted by eight pixels, and as shown in F8, pixel data of the next 16 pixels are transferred. Hereafter, the same operation is repeated.

In this way, according to the embodiment, input data including a plurality of sets of pixel data are written in the FIFO circuit BA2, and the FIFO circuit BA2 sequentially shifts the input data in series. Then, when pixel data at the end of a horizontal scanning line are included in the input data, the input data are shifted until pixel data at the start of the next horizontal scanning line come to the end of the FIFO circuit BA2 (F3 of FIG. 11).

By so doing, it is possible to divide stream image data input as 16-bit parallel data into sets of pixel data for each horizontal scanning line. Because of this, horizontal scanning lines can be divided by a simple operation, and transfer of stream image data can be speeded up. For this reason, it is possible to improve the transfer rate of stream image data from the host 10, and shorten the bus (CPU bus) occupation time of the host 10. Also, when a specification that does not cut off transfer of the stream image data from the host 10 along the way is required, it is possible to simplify the design which satisfies the specification by speeding up the transfer.

7. Electronic Apparatus

Figure 12:
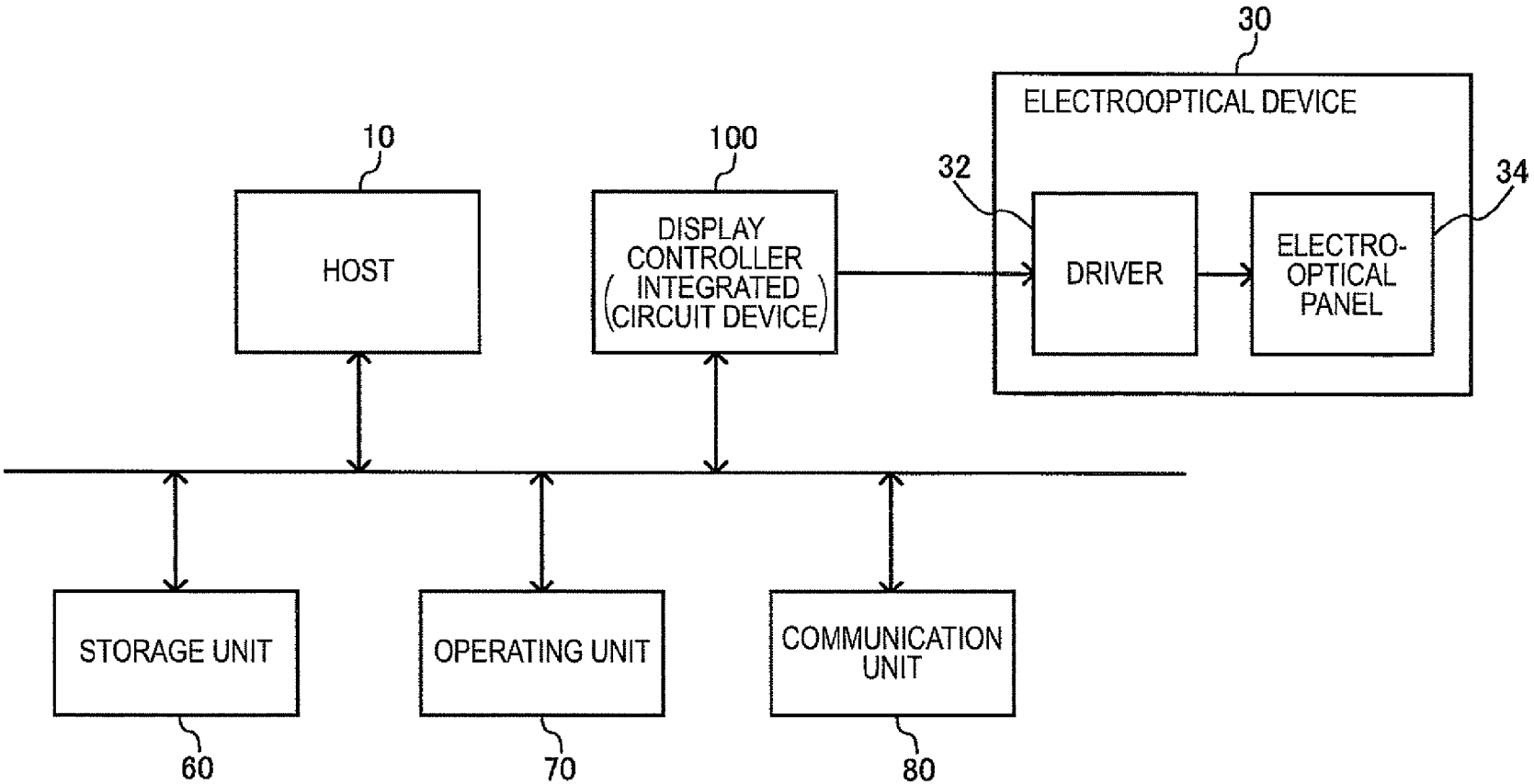
FIG. 12 is a configuration example of an electronic apparatus.

FIG. 12 shows a configuration example of an electronic apparatus including the display controller of the embodiment. The electronic apparatus includes a host 10, a display controller 100 (an integrated circuit device), an electrooptical device 30, a storage unit 60, an operating unit 70, and a communication unit 80. The embodiment is not limited to this configuration example, and it is possible to make various modifications, such as, omission of a portion (for example, the communication unit) of the components, or addition of another component.

It can be assumed that the electronic device of the embodiment is applicable to, for example, a mobile telephone terminal, a mobile information terminal, an electronic book terminal, a mobile game terminal, a digital photo frame or the like.

The host 10 may be realized by, for example, a CPU, and supplies stream image data to the display controller 100, and carries out a control of each component. The display controller 100 may be realized by, for example, an ASIC, and supplies display data to the electrooptical device 30, and carries out a display control of the electrooptical device 30. The electrooptical device 30 includes a driver 32 and an electrooptical panel 34. The driver 32 outputs data voltages and scanning signals, thereby driving the electrooptical panel 34. The electrooptical panel 34 is realized by, for example, a liquid crystal panel or an electrophoretic display (EPD). The storage unit 60 may be realized by, for example, a memory such as an ROM or an RAM, or a hard disc drive, and stores a program for a host, functions as a working memory for a host, and functions as a video memory. The operating unit 70 is configured of, for example, various kinds of buttons or a touch panel, and operating information is input therefrom. The communication unit 80 acquires image data or moving image data by means of wireless communication or wire communication.

As heretofore described, a detailed description has been given of the embodiment, but those skilled in the art will be able to readily understand that many modifications can be made without substantively departing from the new matters and advantages of the invention. Consequently, all of such modifications shall be included in the scope of the invention. For example, terms (the display controller, the first logic level, the second logic level, and the like) described together with broader or synonymous differing terms (the integrated circuit device, inactive, active, and the like) at least once in the specification or drawings can be replaced with the differing terms in any place in the specification or drawings. Also, the configurations and operations of the integrated circuit device, the electrooptical device, the electronic apparatus, and the like are not limited to those described in the embodiment, and various modifications can be made therein.

What is claimed is:

1. An integrated circuit device comprising:

a memory controller that carries out a process of interfacing with an image memory that stores first image data;

a read-modify-write circuit that rewrites the first image data stored in the image memory based on second image data and write enable signals, the read-modify-write circuit includes a first buffer that buffers the second image data; and a second buffer in which stream image data are input as one of the first image data and the second image data, the second buffer converting the format of each set of pixel data of the stream image data into a format of pixel data to be stored in the image memory, and storing the pixel data, the second buffer is formed from a second FIFO in which input data including a plurality of sets of pixel data are written as the stream image data, and that sequentially shifts the input data in series, when the input data includes pixel data at an end of a horizontal scanning line, the second FIFO shifts the input data until pixel data at a start of a next horizontal scanning line come to an end of the second FIFO, thereby cutting the stream image data at each horizontal scanning line, and when the number of bits of each pixel of the first image data is N (N is a natural number), the number of rewrite unit bits of the first image data is M (M is a natural number of M≥N), and the number of bits for which the memory controller can access the image memory at one time is L (L is a natural number of two or more that fulfills L>M), the read-modify-write circuit rewriting L bits of pixel data of the first image data corresponding to active write enable signals for every L/M bits (L and M are each a natural number multiple of N) of the write enable signals.

2. The integrated circuit device according to claim 1, wherein, when the L/M write enable signals corresponding to the L bits are inactive, the read-modify-write circuit does not rewrite corresponding pixel data of the first image data.

3. The integrated circuit device according to claim 1, wherein the first image data rewritten are written in the first buffer.

4. The integrated circuit device according to claim 3, wherein the first buffer has a k×L-bit (k is a natural number)address, and transfers n×k×L bits (n is a natural number of two or more) of data in a burst mode to the image memory.

5. The integrated circuit device according to claim 4, wherein the read-modify-write circuit transmits request signals for n×k×L bits to the memory controller, when reading the first image data from the image memory.

6. The integrated circuit device according to claim 5, wherein the read-modify-write circuit transmits n×k request signals as the request signals for N×k×L bits, and when the write enable signals corresponding to the L bits are inactive, makes corresponding request signals, among the n×k request signals, inactive.

7. The integrated circuit device according to claim 4, wherein the first buffer is formed from a first FIFO, the first FIFO having a variable row number that is m (m is a natural number), and the transfer in the burst mode is controlled such that n×m is constant.

8. An electronic device comprising:

the integrated circuit device according to claim 1.

* * * * *